US008551602B2

(12) United States Patent
Geraedts et al.

(10) Patent No.: US 8,551,602 B2
(45) Date of Patent: Oct. 8, 2013

(54) SPORT-TECHNICAL LAYER FOR USE IN AN ARTIFICIAL LAWN SYSTEM, AS WELL AS SUCH AN ARTIFICIAL LAWN SYSTEM

(75) Inventors: Klim Geraedts, Culemborg (NL); Marinus Hendrikus Olde Weghuis, Oldenzaal (NL); Franciscus Gerhardus Maria Kokkeler, Enschede (NL); Adrianus Lambertus Antonius Mulders, Culemborg (NL)
(73) Assignee: Sekisui Chemical Co., Ltd., Osaka (JP)

( * ) Notice: Subject to any disclaimer, the term of this patent is extended or adjusted under 35 U.S.C. 154(b) by 406 days.
(21) Appl. No.: 12/670,747
(22) PCT Filed: Jul. 21, 2008
(86) PCT No.: PCT/EP2008/005944
§ 371 (c)(1),
(2), (4) Date: Apr. 12, 2010
(87) PCT Pub. No.: WO2009/015795
PCT Pub. Date: Feb. 5, 2009
(65) Prior Publication Data
US 2010/0196667 A1 Aug. 5, 2010
(30) Foreign Application Priority Data
Aug. 2, 2007 (NL) ..... 1034221
(51) Int. Cl.
*B32B 3/00* (2006.01)
*B32B 3/12* (2006.01)
*B32B 3/26* (2006.01)
*B32B 3/28* (2006.01)
*B32B 3/30* (2006.01)
(52) U.S. Cl.
USPC ..... 428/167; 428/156; 428/158
(58) Field of Classification Search
USPC ..... 428/17, 156, 167, 158
See application file for complete search history.

(56) References Cited

U.S. PATENT DOCUMENTS 4,436,779 A 3/1984 Menconi et al.
2005/0042394 A1* 2/2005 Sawyer et al. ..... 428/17

FOREIGN PATENT DOCUMENTS

CA 2 514 684 2/2007
CN 1644798 7/2005
CN 1734163 2/2006
EP 1 696 077 8/2006
WO 2006/010342 2/2006

OTHER PUBLICATIONS

Chinese Office Action issued Mar. 24, 2011 in Chinese Application No. 200880101612.2.

(Continued)

*Primary Examiner* — Catherine A Simone
(74) *Attorney, Agent, or Firm* — Wenderoth, Lind & Ponack, L.L.P.

(57) ABSTRACT

The invention relates to a sport-technical layer for use in an artificial lawn system in particular intended for sports fields, which artificial lawn system is built up at least of a substrate to which artificial grass fibres are attached as well as the sport-technical layer extending under said substrate, which sport-technical layer comprises at least one damping sublayer made of a synthetic foam, which damping sublayer made of a synthetic foam is built up of an essentially rigid flat plate, which plate is provided with flatness-enhancing means. The invention further relates to an artificial lawn system provided with such a sport-technical layer. According to the invention, the sport-technical layer is to that end characterised in that said flatness-enhancing means comprise at least one first slot assembly of at least two closely spaced slots formed in a respective upper surface or bottom surface of the plate, which slots extend in a first direction of the plate. As a result, the sport-technical layer is constructionally guaranteed to be a flat layer not exhibiting any warped or overlapping portions. On the one hand this leads to improved functional characteristics of the artificial lawn system to be ultimately constructed, but in addition this prevents the unnecessary work and expenses involved in repairing a non-level sport-technical layer, which currently takes place with the artificial lawn system according to the prior art.

15 Claims, 15 Drawing Sheets

(56) References Cited

OTHER PUBLICATIONS

Chinese Office Action issued Feb. 13, 2012 in Chinese Application No. 200880101612.2.

Australian Examination Report issued May 31, 2011 in Australian Application No. 582475.

International Search Report issued Oct. 14, 2008 in International (PCT) Application No. PCT/EP2008/005944.

International Preliminary Report on Patentability issued Feb. 2, 2010 in International (PCT) Application No. PCT/EP2008/005944.

* cited by examiner

SPORT-TECHNICAL LAYER FOR USE IN AN ARTIFICIAL LAWN SYSTEM, AS WELL AS SUCH AN ARTIFICIAL LAWN SYSTEM

BACKGROUND OF THE INVENTION

I. Technical Field

The invention relates to a sport-technical layer for use in an artificial lawn system, in particular, intended for sports fields, which artificial lawn system is built up at least of a substrate to which artificial grass fibres are attached as well as the sport-technical layer extending under the substrate, which sport-technical layer comprises at least one damping sublayer made of a synthetic foam, which damping sublayer made of a synthetic foam is built up of an essentially rigid flat plate, which plate is provided with flatness-enhancing means.

The invention further relates to an artificial lawn system comprising such a sport-technical layer.

II. Description of the Related Art

At present, plastics are used for all kinds of different purposes, in particular the use of all kinds of plastics in artificial lawns for sports fields has developed strongly. The development of artificial grass fibres and artificial grass sports fields derived therefrom has progressed to such an extent that it is now possible to construct artificial grass sports fields which are hardly distinguishable from natural grass sports fields as regards their appearance but in particular as regards their playing characteristics.

The last few years research has been focused in particular on the development of artificial grass fibres for use in artificial lawns for sports fields, taking into account the fact that each individual sport has its own specific requirements as regards the subsoil and the surface properties.

Also in the development of new aspects of the sport-technical layer as used in an artificial lawn system the focus has been on the materials that are used. It should be taken into account in that regard that the sport-technical layer must in principle exhibit a sufficient degree of damping or resilience, so that on the one hand the characteristics of a natural lawn system are imitated as much as possible for the user, whilst on the other hand this must not adversely affect the playing characteristics, whilst furthermore the risk of injuries and the like must be prevented as much as possible. Problems that are currently experienced in the present artificial lawn systems, and in particular the sport-technical layer, inter alia concern the construction and maintenance of such an artificial lawn system. In the existing artificial lawn systems, the sport-technical layer is generally built up of a large number of plates, which are arranged in abutting relationship on a foundation layer. It has been found, however, that due to factors such as the action of sunlight but also the occurrence of temperature differences between the bottom side and the upper side of the layer as well as factors such as the dimensions and the water balance, the existing plates intended for use as a sport-technical layer are not dimensionally stable but are highly susceptible to warping and omnilateral expansion, as a result of which the connection between the plates and the functionality of the sport-technical layer is lost.

Thus, the overall connection between the various plates can no longer be guaranteed and the further construction of the artificial lawn system will be difficult if not altogether impossible because the individual plates are warped and overlap one another.

SUMMARY OF THE INVENTION

It will be understood that a good quality sport-technical layer plays an essential part, also from a constructional point of view, as regards the overall (playing) characteristics of the artificial lawn system to be laid out thereon.

Accordingly it is the object of the invention to provide a sport-technical layer as well as an artificial lawn system as referred to in the introduction, in which the sport-technical layer forms a solid constructional base for the overall lawn system without exhibiting the aforesaid drawbacks.

According to the invention, the sport-technical layer is to that end characterised in that the flatness-enhancing means comprise at least one first slot assembly of at least two closely spaced slots formed in a respective upper surface or bottom surface of the plate, which slots extend in a first direction of the plate. As a result, the sport-technical layer is constructionally guaranteed to be a flat layer not exhibiting any warped or overlapping portions. On the one hand this leads to improved functional characteristics of the artificial lawn system to be ultimately constructed, but in addition this prevents the unnecessary work and expenses involved in repairing a non-level sport-technical layer, which is currently necessary with the artificial lawn system according to the prior art.

The use of a slot assembly extending in a first direction of the plate enables the plate to compress and extend under the influence of, for example, form loads in a first direction or of temperature differences, moisture, etc. In this way warping of the plate is no longer possible, because the respective stresses that lead to warping of the material of the plate are taken up by the slot assembly.

It is also possible to use slot assemblies comprising several slots, of course, such as a slot assembly made up of at least three slots, two slots being provided in the upper surface or the bottom surface and the third slot being provided in the bottom surface or the upper surface, respectively.

Another embodiment of the sport-technical layer according to the invention and of the artificial lawn system according to the invention is characterised in that the flatness-enhancing means comprise at least one second slot assembly of two closely spaced slots formed in a respective upper surface or bottom surface of the plate, which slots extend in another direction of the plate. By using additional slot assemblies, which now extend in the other direction of the plate relative to the first slot assemblies, any warping in the other direction can likewise be taken up in an effective manner, so that the sport-technical layer will retain its flatness in both directions.

More specifically, according to the invention the slots have a depth equaling minimally 50% and maximally 95% of the thickness of the plate. As a result, any unflatness in the sport-technical layer can be effectively eliminated or corrected.

According to another functional embodiment, the sport-technical layer and the artificial lawn system are further characterised in that the plate is provided with an opening at the location of the intersection of two first and second slot assemblies formed in the first and the second, respectively, direction of the plate. Said openings can be usefully used as passages for rain water, thus making it possible to realise an effective drainage of the artificial lawn system.

Such drainage openings may of course also be formed in a very simple manner by using a punch or drilling technique, by which holes are formed through the plate of the sport-technical layer.

In a functional embodiment of the sport-technical layer according to the invention, at least one of said first and second slot assemblies extends in a direction parallel to a longitudinal direction of the plate.

In another embodiment, at least one of said first and second slot assemblies extends at an angle relative to a longitudinal direction of the plate. It is possible in this regard to orient at least one (or both) of said first and second slot assemblies diagonally relative to the longitudinal direction of the plate, which can be realised by means of a simple material removing technique.

In another useful embodiment, said first and second slot assemblies may furthermore extend transversely to each other in the plate.

More specifically, the invention also relates to a method for forming a sport-technical layer according to the invention, which method comprises the steps of:

i) supplying an essentially rigid, flat plate;

ii) forming the first slot assemblies as described in this application, which function as flatness-enhancing means, in a direction transversely to the supplying direction during step i).

In this way the slots can be formed in one operation, without operations needing to be stopped or re-setting being required.

The method may further be characterised by the step of:

iii) forming the second slot assemblies as described in this application, which function as flatness-enhancing means, in a direction opposed to the direction referred to in step ii) direction during step i).

In another embodiment according to the invention, the flatness-enhancing means consist of a local reduction in the stiffness of the material of the plate. This can be realised on the one hand by locally forming the plate of a less rigid second material, whilst in another embodiment of the invention the flatness-enhancing means consist of a local reduction in the stiffness of the material, which is for example realised by locally forming the plate of a material having a lower density.

The two latter solutions do not present so much a mechanical embodiment as an embodiment which must be realised during the production of the sport-technical layer already, in which case the reduced-density portion of the plate realises a deformation and thus a flatness-enhancing property.

BRIEF DESCRIPTION OF THE DRAWINGS

More specifically, the sport-technical layer is to that end characterised in that it is configured as a damping plate capable of being unrolled, which is provided with flatness-enhancing means as described above.

The invention will now be explained in more detail with reference to the drawing, in which.

DETAILED DESCRIPTION OF THE INVENTION

Figure 1:
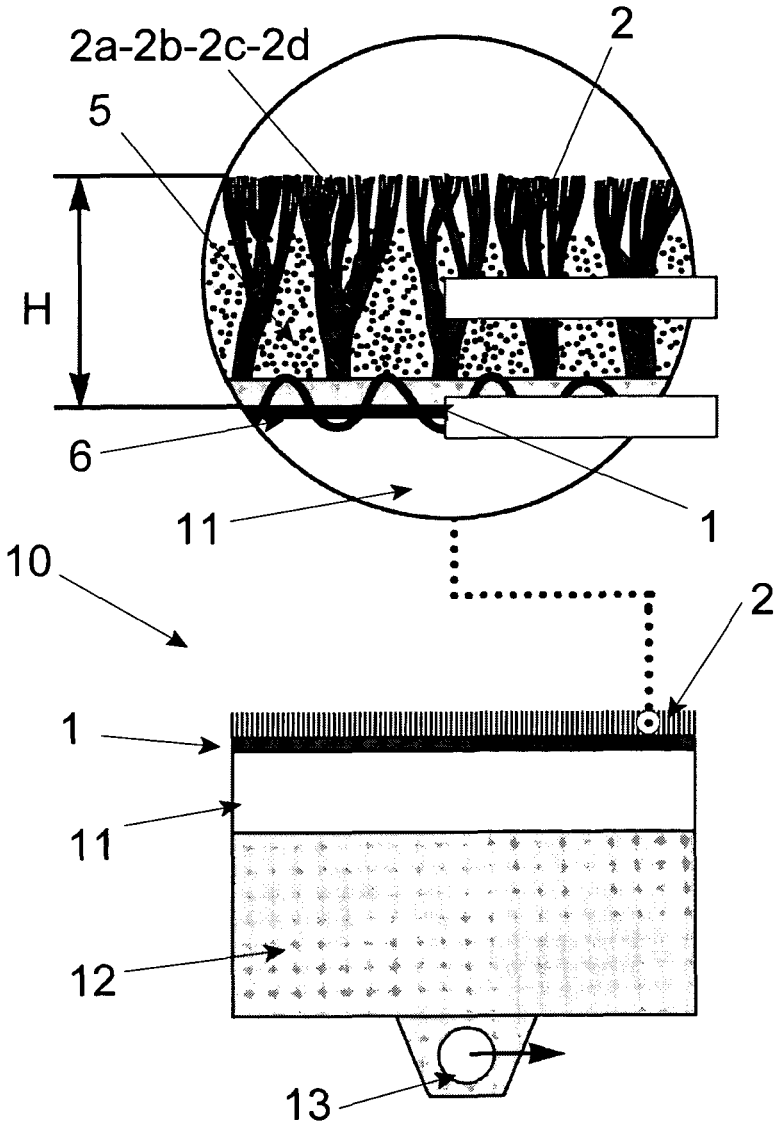
Fig.1 (prior art)
FIG. 1 schematically shows an embodiment of an artificial lawn according to the prior art.

FIG. 1 shows an embodiment of a known artificial lawn 10 according to the prior art, in which a standard synthetic fibre can be used. The artificial lawn 10 comprises a substrate 1, to which several synthetic fibres 2 are attached, for example by tufting.

The synthetic fibres are generally made up of one or more synthetic fibres 2*a*-2*b*-2*c*-2*d*-etc., which synthetic fibres may consist of fibrillated and/or monofilament fibres, for example as described in International patent application WO2004/077914. This makes it possible to create synthetic fibres substantially fully resembling natural grass fibres. Such fibres 2*a*-2*d* can be produced by means of known production techniques, such as extrusion. The individual fibres 2*a*-2*d* thus obtained, for example by extrusion, can be twined to form the synthetic fibre 2 and subsequently be attached to the substrate 1.

In FIG. 1 the substrate is placed on a surface having sport-technical properties, which surface may be made up of layers 11 and 12. The sport-technical layer 11 may comprise an elastic-damping layer 6 (said optional layer 6 may also form part of the substrate 1). The layer 12 forms the foundation of the artificial lawn 10 and is built up of a coarse sublayer of for example stones and a fine sublayer of sand. The artificial lawn system 10 is provided with a drainage system, indicated at 13, for draining rain water.

An infill material 5 may be provided between the artificial grass (sports) fibres 2, although this is not necessary for a clear understanding of the present invention.

Figure 2:
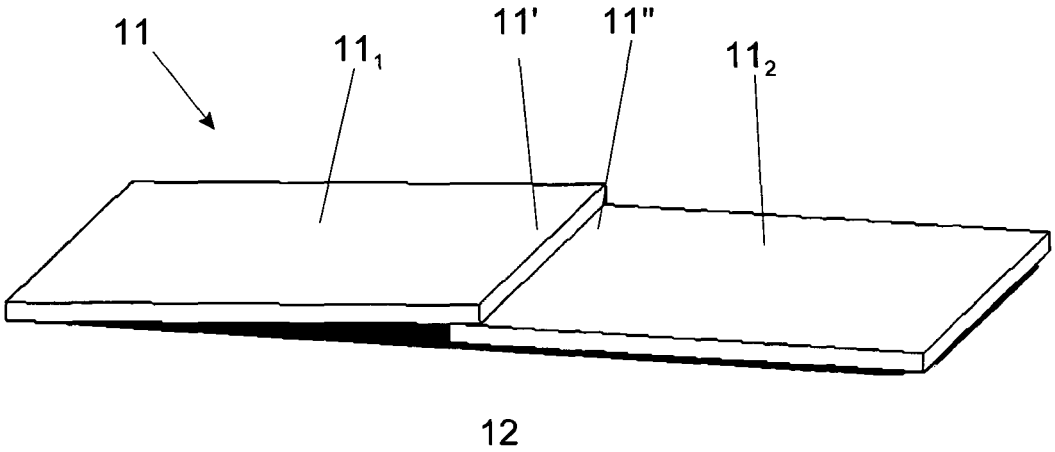
Fig. 2 (prior art)
FIG. 2 shows an embodiment of a sport-technical plate for use in an artificial lawn according to the prior art.

The sport-technical layer 11 of the sports fields which are presently known is built up of individual plates $\mathbf{11}_1$, $\mathbf{11}_2$, etc, which are placed with their edges 11' and 11" in abutment with each other on the foundation layer 12 upon construction of the field (see FIG. 2).

A drawback of a sport-technical layer 11 built up of individual plates is that the edges 11' and 11" of adjacent plates $\mathbf{11}_1$, $\mathbf{11}_2$ tend to over overlap, as is clearly shown in FIG. 2, under the influence of temperature, moisture and expansion.

Figure 3A:
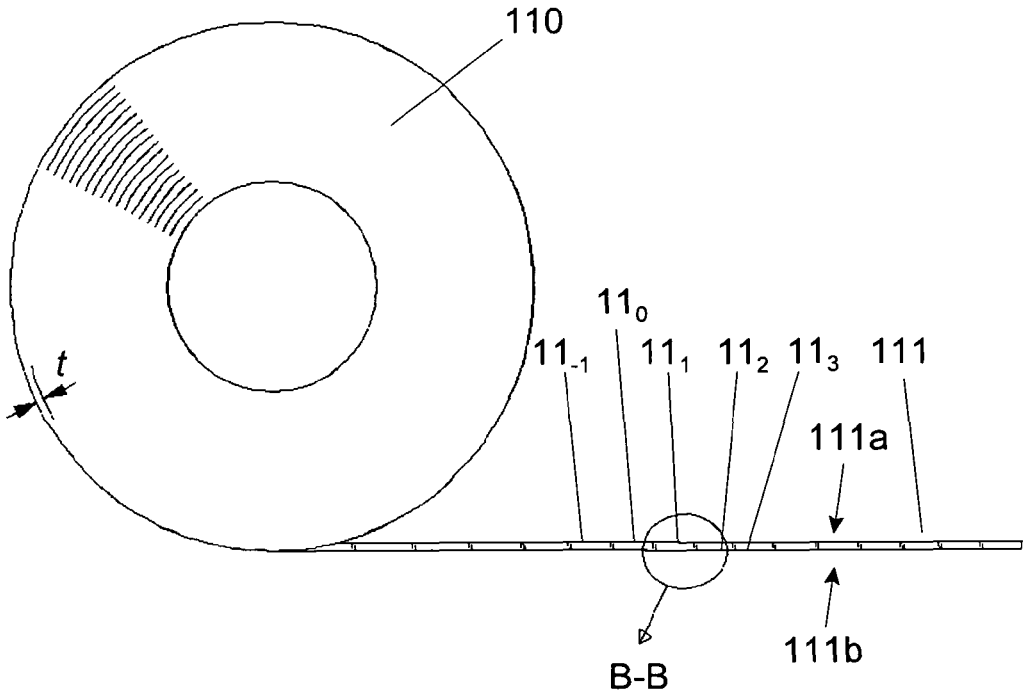
FIG. 3*a* shows an embodiment of a sport-technical layer according to the invention.

FIG. 3*a* shows an embodiment of a sport-technical layer 111 according to the invention. The sport-technical layer 111 is configured as a roll 110 capable of being unrolled, making it possible to lay out the sport-technical layer upon constructing the artificial lawn system. According to the invention, the sport-technical layer 111, which is capable of being unrolled, is built up of several plate sections $\mathbf{11}_{-1}$, $\mathbf{11}_0$, $\mathbf{11}_1$, $\mathbf{11}_2$, $\mathbf{11}_3$, etc, which are interconnected in the manner shown in FIG. 3*b* or 3*c*.

The sport-technical layer 111 has a thickness t.

Figure 3B:
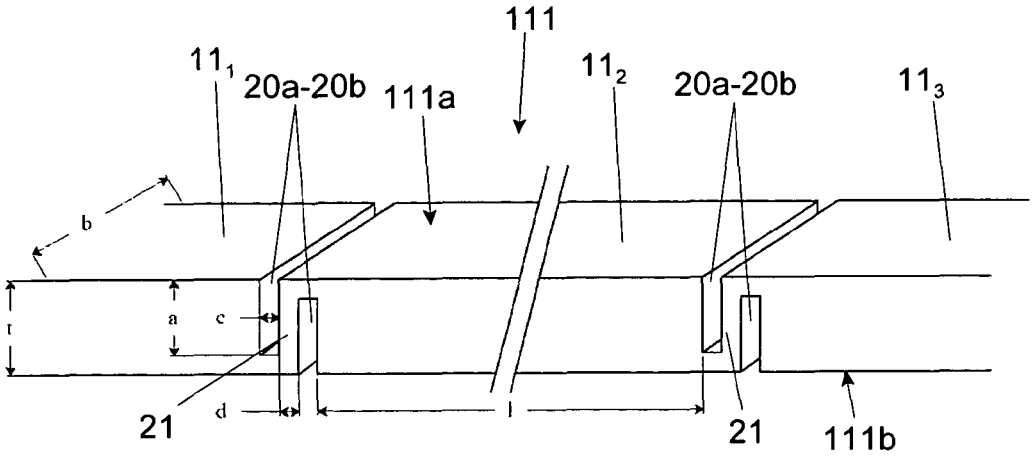
FIG. 3*b* shows a detail of FIG. 3*a;*

As shown in FIG. 3*b*, the sport-technical layer 111 is provided with flatness-enhancing means, which are here configured as several slot assemblies each built up of two closely spaced slots 20*a*-20*b* formed in an upper surface 111*a* and a bottom surface 111*b*, respectively, of the plate 111 and extending in a first longitudinal direction of said plate 111. The two slots 20*a*-20*b* of the slot assembly are separated from each other by an intermediate flange 21.

Figure 3C:
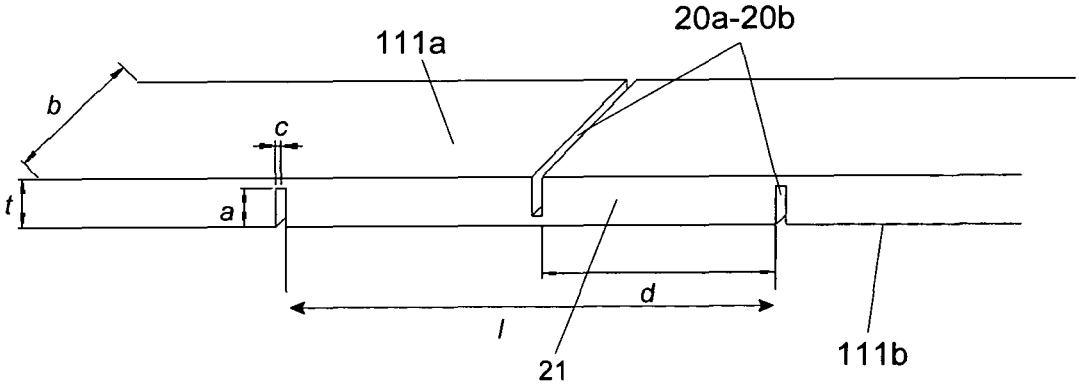
FIG. 3*c* shows another embodiment of a sport-technical layer according to the invention.

The intermediate flange 21 has a length (or thickness) d which, in FIG. 3*b*, equals (or substantially equals) the width c of the slots 20*a*-20*b* (d=c). FIG. 3*c* shows an embodiment of a sport-technical layer 111 comprising a slot assembly made up of slots 20*a*-20*b* which are clearly spaced further part (d>>c).

The depth of the two slots 20*a*-20*b* is indicated a and preferably amounts to 50% to 95% of the thickness t of the sport-technical layer 111. More in particular it has been found that a depth a of 60%-85%, more in particular 80%, of the thickness t is preferable with a view to obtaining an optimum flatness of the sport-technical layer 111. The thickness t of the sport-technical layer 111 may be 5-30 mm, more in particular 10-15 mm. The width c of each slot is determined by the coefficient of expansion of the material in question and is inherent to the length l of each plate section $11_1$, $11_2$, $11_3$, etc. The length l may be 20-60 mm, for example, in particular 40-50 mm. The width of the slots on either side of the connection between two adjacent plates must at least be sufficient to take up the expansion of one plate.

According to the invention, the sport-technical layer 111 is excellently suited for taking up forces that act on the plates $11_1$, etc. in one or both longitudinal directions of the sport-technical layer 111. This is shown in FIGS. 4*a*-4*b*, in which FIG. 4*a* shows the sport-technical layer in unloaded condition and FIG. 4*b* shows the sport-technical layer in loaded condition. When a deformation force P is applied to the sport-technical layer 111 in one or both longitudinal directions thereof, the intermediate flange portion 21 between the two slots 20*a* and 20*b* functions as a spring element that takes up the deformation in the material.

FIGS. 4*c*-4*d* show the sport-technical layer 111 of FIG. 3*c* in unloaded condition and in loaded condition, respectively.

In this way warping of the plates $11_1$, $11_2$, $11_3$, etc under the influence of certain compressive or tensile stresses that may be set up in the material due to temperature changes, moisture and/or expansion is prevented. In fact, the slot assemblies 20*a*-20*b* ensure that the flatness of the sport-technical layer 111 is retained. Not only does this have a positive effect on the playing characteristics of the artificial lawn system, but in addition it makes the construction thereof significantly simpler and less costly.

When a force is exerted on the sport-technical layer, for example during the installation thereof, the connections between the plates must not give way. The tensile force exerted on the connection must not exceed the maximum material stress multiplied by the contact area of the connection.

Figure 5A:
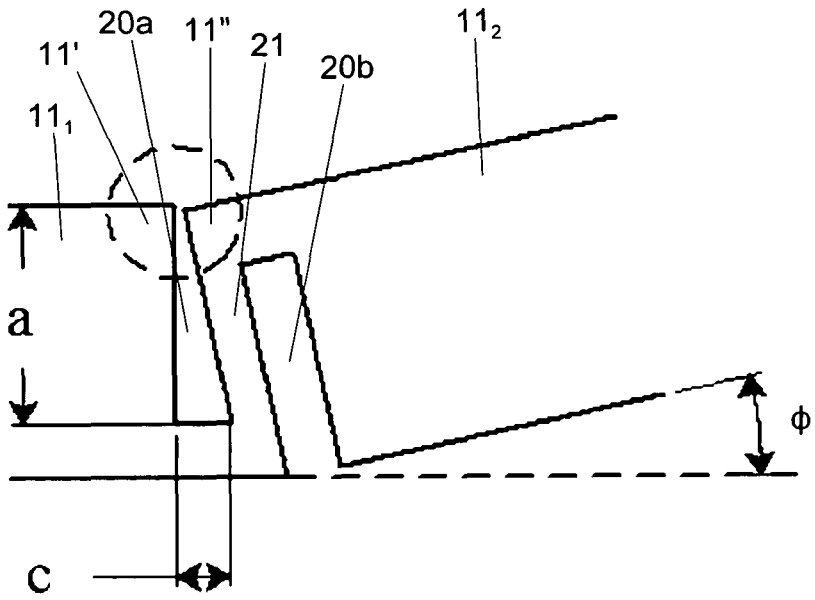
FIGS. 5*a*-5*b* show the sport-technical layer of FIGS. 3*b* and 3*c* respectively in another condition.

An advantage of the sport-technical layer 111 (of FIG. 3*a*) provided with flatness-enhancing means 20*a*-20*b* is shown in FIG. 5*a*, in which the successive plate sections $11_1$, $11_2$ can be oriented at an angle ϕ under the influence of the slot assemblies 20*a*-20*b*. On the one hand this makes it possible to lay out an artificial lawn system with an incline, for example in the case of a golf course, which must not by definition be 100% flat. Above all, the angular adjustment between the two successive plates $11_1$, $11_2$ makes it possible to supply the sport-technical layer 111 in the form of a roll 110 (see FIG. 3*a*) capable of being unrolled at the site of the artificial lawn system to be constructed. The angle ϕ is in large measure determined by the width c of the slots 20*a*-20*b* in that the angular distortion of two successive plate sections is stopped by the end edges 11'-11" of the plate sections. The angle ϕ is determined by the width c and the depth a of the slots 20*a*-20*b*. The width c of the slots may be 1-5 mm.

Figure 5B:
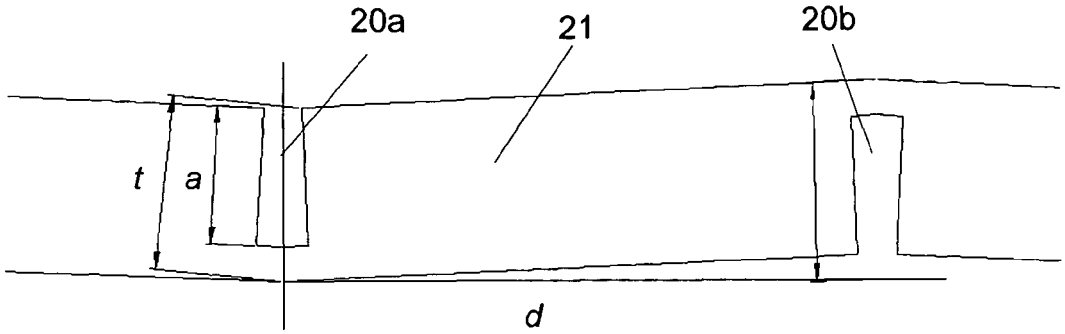

FIG. 5*b* shows the sport-technical layer 111 of FIG. 3*c*.

Figure 4:
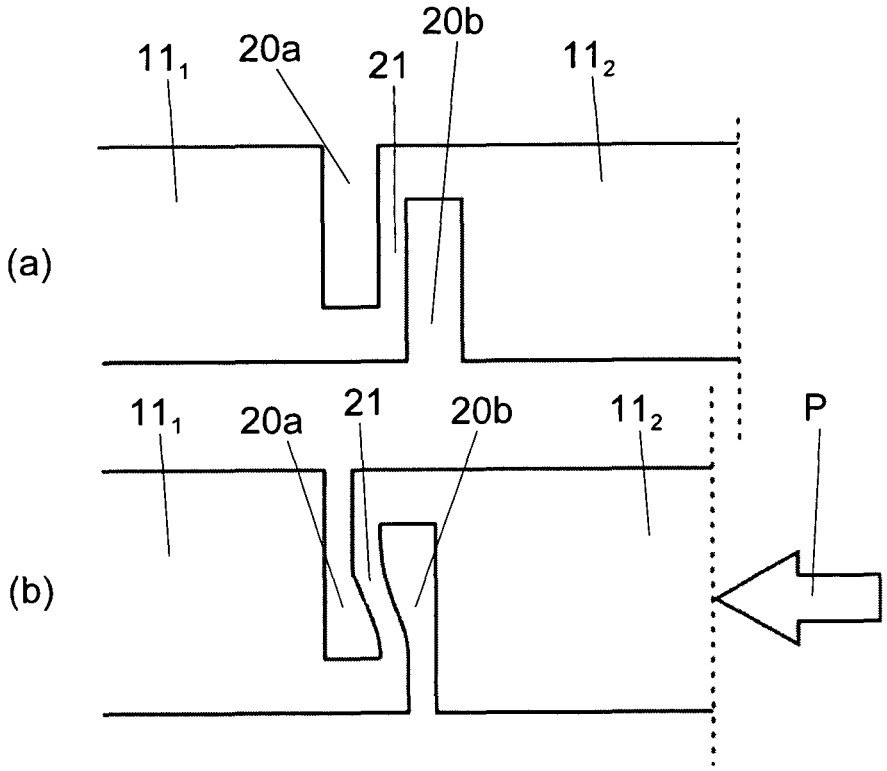
FIGS. 4*a*-4*d* show the sport-technical layer of FIGS. 3*b* and 3*c* in unloaded and in loaded condition.
Figure 4:
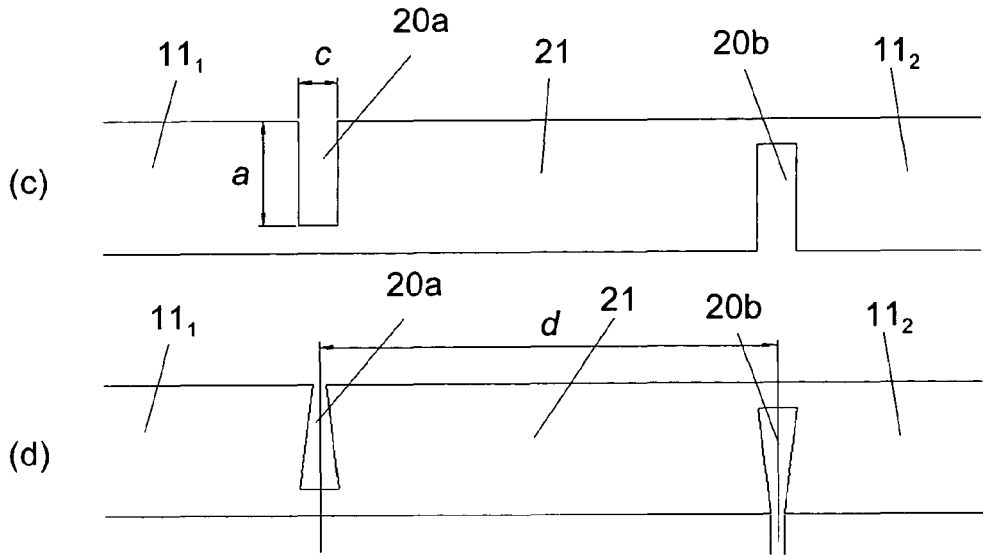
Figure 6:
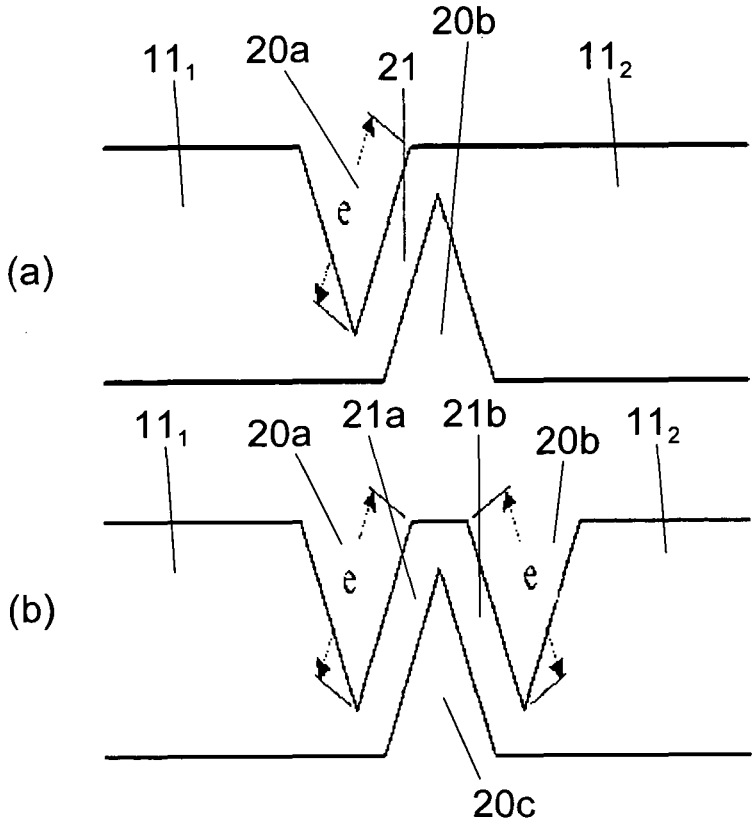
FIG. 6 shows another embodiment of a sport-technical layer according to the invention.

FIG. 6 shows an alternative embodiment of the flatness-enhancing means provided in a sport-technical layer 111 according to the invention, in which the slots 20*a*-20*b* are not configured as rectangular slots as in FIG. 3*b*, FIG. 4 and FIG. 5, but as angular slots separated by an intermediate flange portion 21.

Whilst FIG. 6*a* discloses a slot assembly made up of two adjacent, parallel slots 20*a*-20*b*, the embodiment of FIG. 6*b* shows three slots 20*a*-20*c*, which are separated from each other by two intermediate flange portions 21*a*-21*b*. It will be apparent that also the embodiments comprising a rectangular slot assembly as shown in FIGS. 3*a*-4-5 may be configured with an additional slot, in which case two slots are present in one side 11*a* (or 11*b*) of each plate section and the third slot is present in the other side 11*b* (or 11*a*), wherein the two slots formed in one side of the plate section are separated from each other on either side by the other slot formed in the other side.

Figure 7A:
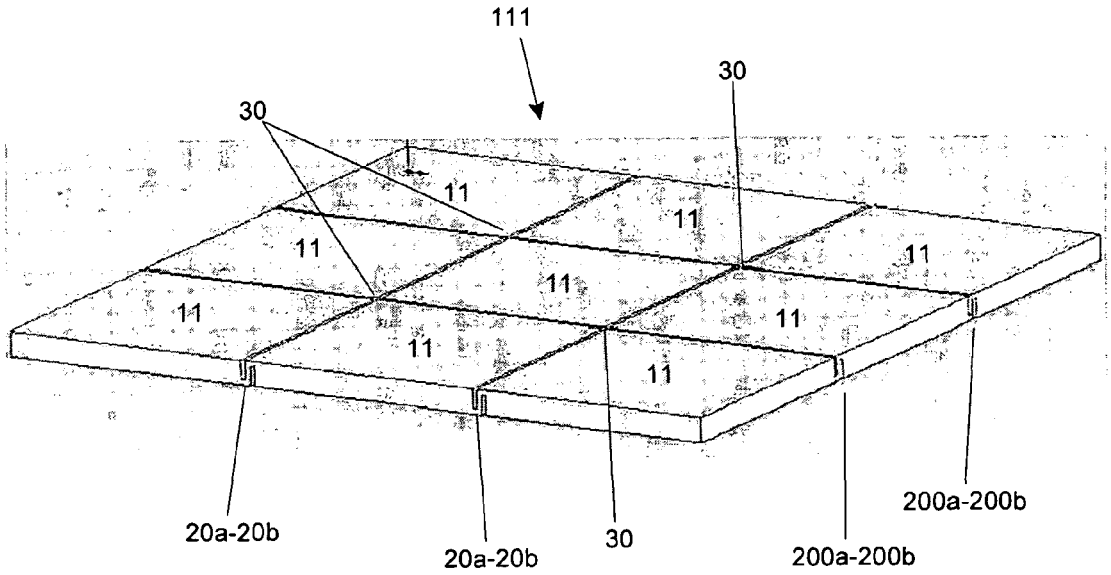
FIGS. 7*a*-7*c* show another aspect of a sport-technical layer according to the invention.
Figure 7B:
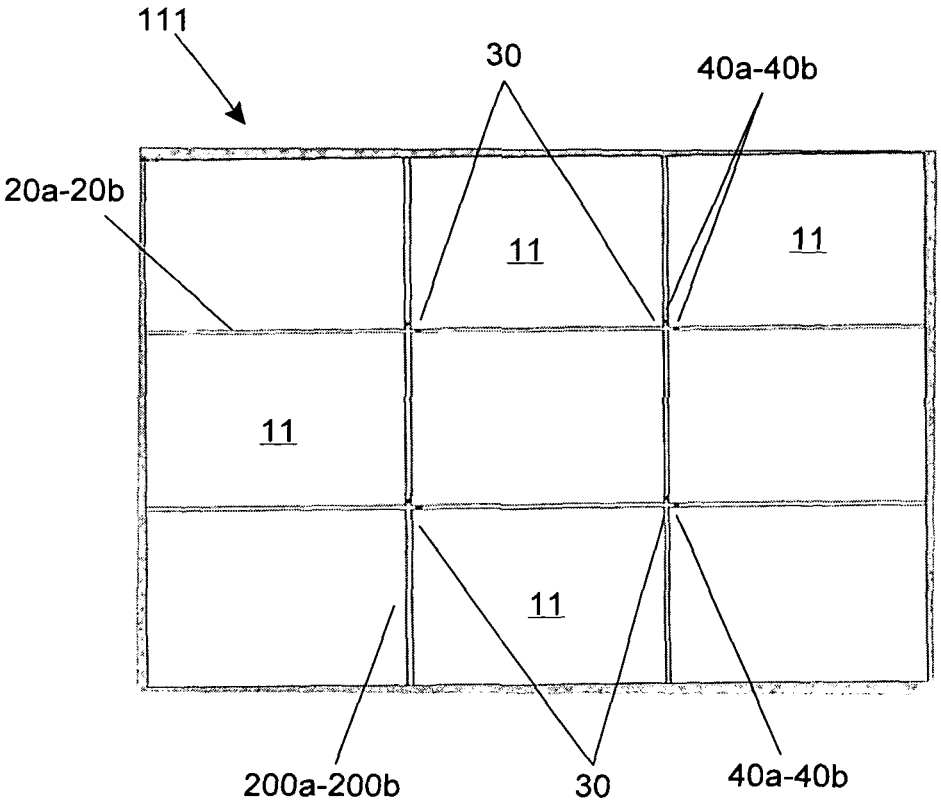
Figure 7C:
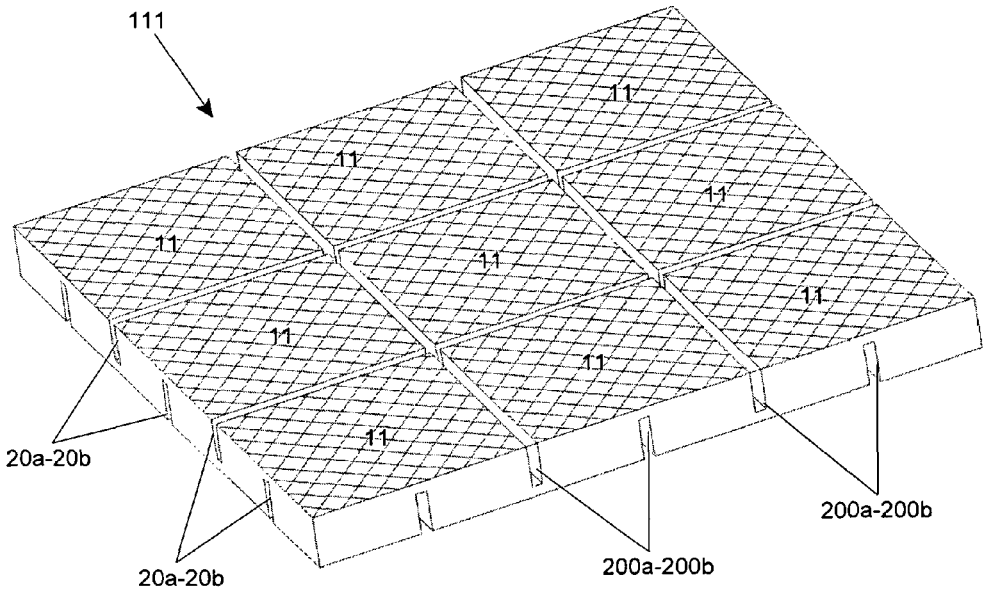

FIGS. 7*a*, 7*b* and 7*c* show an embodiment of a sport-technical layer 111 provided with flatness-enhancing means provided in one longitudinal direction and as well as in the other longitudinal direction. The flatness-enhancing means are to that end formed by slot assemblies 20*a*-20*b* and 200*a*-200*b*, respectively, which slot assemblies 20*a*-20*b* extend transversely and perpendicularly to the slot assemblies 200*a*-200*b*. The slot assemblies intersect at the locations indicated at 30.

As already said before, the depth a of the various slots 20*a*-20*b* and 200*a*-200*b*, respectively, is minimally 50% and maximally 95% of the thickness t of the sport-technical layer 111. The advantage of this is that openings 40*a*, 40*b* are formed at the locations 30 where the slot assemblies 20*a*-20*b* intersect the other slot assemblies 200*a*-200*b*, which openings can function as drainage holes for diverting moisture into the ground for draining the artificial lawn system.

It is also possible, however, to punch or to drill holes elsewhere in the various plate sections 11, making it possible to drain rain water.

It will be understood that other embodiments of the invention may be characterised in that other shapes/configurations of slot assemblies are provided, which perform the same flatness-enhancing function as the slot assemblies described in the present application.

Figure 8A:
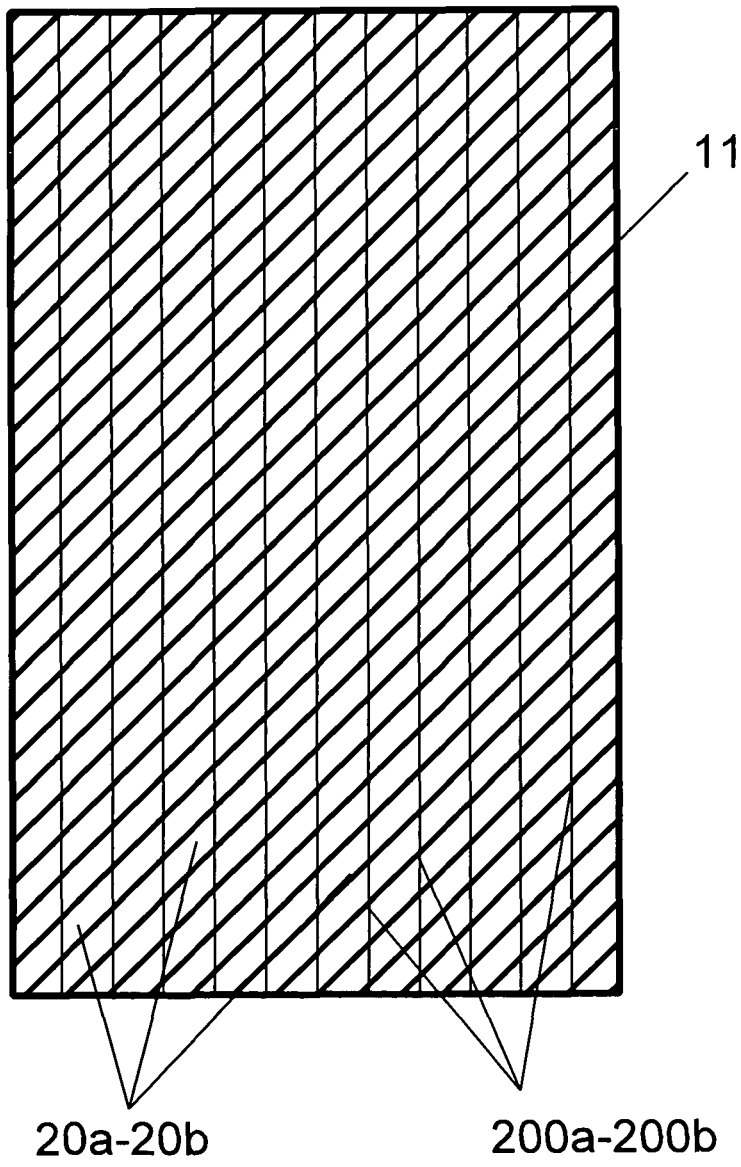
FIGS. 8*a*-8*b* show further embodiments of a sport-technical layer according to the invention.
Figure 8B:
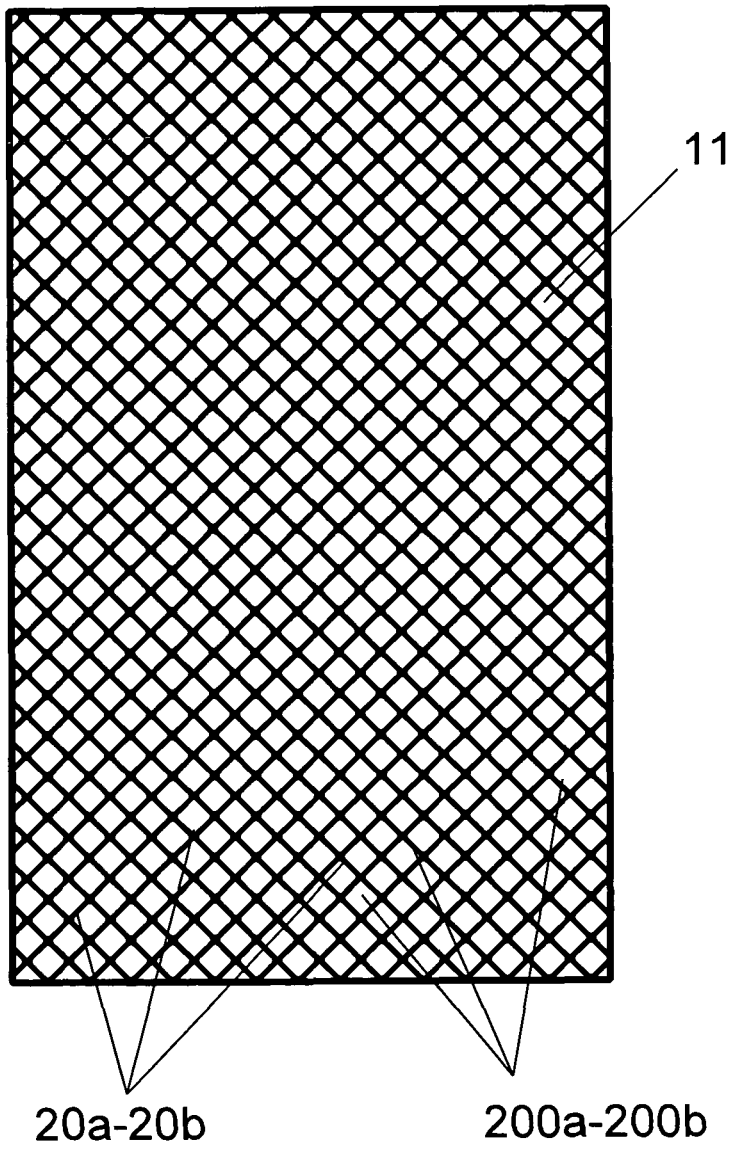

Alternative embodiments of a sport-technical layer according to the invention are shown in FIGS. 8*a* and 8*b*. In FIG. 8*a* the first slot assemblies 20*a*-20*b* extend at an angle the longitudinal direction of the plate 11, whilst the second slot assemblies 200*a*-200*b* extend parallel to said longitudinal direction. The slot assemblies 20*a*-20*b* and 200*a*-200*b* thus intersect each other at an angle (in this case an angle of 45°-135°. In FIG. 8*b* the first and the second slot assemblies 20*a*-20*b* and 200*a*-200*b*, respectively, extend at a (diagonal) angle relative to longitudinal direction of the plate 11, such that said slot assemblies intersect each other perpendicularly) (90°).

The invention also relates to an artificial lawn system comprising a sport-technical layer provided with flatness-enhancing means as described herein, which sport-technical layer may be configured as a damping plate which may be capable of being unrolled or be built up of individual plate sections.

The degree and the manner of warping of two polyolefin foams have been compared with each other by way of example, which comparison was modulated by means of a programme according to the finite element method.

SAMPLE 1

Polyolefin foam, used as a sport-technical layer, only provided with perforation holes.
Specifications:

| | |
|---|---|
| Density: | 67 kg/m$^3$ |
| Thickness (t): | 10 mm |
| Diameter perforation holes: | 8 mm |

Spacing between the perforation holes both in longitudinal direction and in transverse direction: 70 mm

SAMPLE 2

Polyolefin foam, used as a sport-technical layer, provided with flatness-enhancing means according to the invention.

Specifications:

| | |
|---|---|
| Density: | 67 kg/m$^3$ |
| Thickness (t): | 10 mm |
| Length (l) of each plate section: | 40 mm |
| Width (c) of the slots: | 1.5 mm |
| Depth (a) of the slots: | 8 mm |

Warping:

The polyolefin foam of sample 1 resulted in omnilateral warping caused by omnilateral thermal expansion of as much as 1.5% at a temperature increase of 50° C.

The polyolefin foam of sample 2, on the other hand, exhibited 0% warping.

This shows that warping of the foam caused by thermal expansion is entirely prevented by the provision of flatness-enhancing means according to the invention.

Drainage:

Furthermore, the difference in drainage capacity between the polyolefin foam of Sample 1 and Sample 2 was examined. Foam Sample 1 was used as the reference sample, because this foam has already been certified according to FIFA rules and meets a drainage requirement of minimal 180 mm/h. Flow modelling software shows that the drainage capacity of foam of sample 2, which is provided with flatness-enhancing means, is 30% better than that of the polyolefin foam of Sample 1.

It will furthermore be understood that the present invention is not limited to the use thereof in artificial lawn systems, but that it is also suitable for other applications which require the use of foamed (insulation) layers, which, upon installation, cause the same expansion or flatness problems.

The invention claimed is:

1. A sport-technical layer for use in an artificial lawn system for sports fields, the artificial lawn system including at least a substrate to which artificial grass fibers are attached, and the sport-technical layer being configured to extend under the substrate, said sport-technical layer, comprising:

at least one damping sublayer made of a synthetic foam, the at least one damping sublayer including an essentially rigid flat plate, the essentially rigid flat having an upper surface, a lower surface and a flatness-enhancing device, the flatness-enhancing device having a first slot assembly having first and second slots and a second slot assembly having first and second slots, the first slot of the first slot assembly being disposed in the upper surface of the essentially rigid flat plate and the second slot of the first slot assembly being disposed in the bottom surface of the essentially rigid flat plate, the first and second slots of the first slot assembly being separated from each other by an intermediate flange, and the first and second slots of the first slot assembly being spaced further apart than the width of the slots, the first and second slots of the first slot assembly extending in a first direction along the essentially rigid flat plate, and the first slot of the second slot assembly being disposed in the upper surface of the essentially rigid flat plate and the second slot of the second slot assembly being disposed in the bottom surface of the essentially rigid flat plate, the second slot assembly extending in a second direction along the essentially rigid flat plate, the first and second directions being different from each other.

2. A sport-technical layer according to claim 1, wherein the first slot assembly includes a third slot in the upper surface or the bottom surface.

3. A sport-technical layer according to claim 1, wherein each of the slots have a depth equaling minimally 50% and maximally 95% of the thickness of the plate.

4. A sport-technical layer according to claim 3, wherein the essentially rigid flat plate includes an opening at an intersection of said two first and second slot assemblies.

5. A sport-technical layer according to claim 1, wherein at least one of the first and second slot assemblies extends in a direction parallel to a longitudinal direction of the plate.

6. A sport-technical layer according to claim 1, wherein at least one of said first and second slot assemblies extends at an angle relative to a longitudinal direction of the plate.

7. A sport-technical layer according to claim 1, wherein the first and second slot assemblies extend transversely to each other in the plate.

8. A sport-technical layer according to claim 1, wherein the length of the essentially rigid flat plate is 20-60 mm.

9. A sport-technical layer according to claim 1, wherein the thickness of the essentially rigid flat plate is 5-30 mm.

10. A damping plate capable of being unrolled, for use in an artificial lawn system, the damping plate including the flatness-enhancing device according to claim 1.

11. Individual plate sections for use in an artificial lawn system, the individual plate sections including the flatness-enhancing device according to claim 1.

12. An artificial lawn system suitable for sports fields, the artificial lawn system including a substrate to which artificial grass fibers are attached, and sport-technical layer according to claim 1, the sport-technical layer extending under the substrate.

13. A method for forming a sport-technical layer according to claim 1, the method comprising:

i) supplying an essentially rigid, flat plate;

ii) forming the first slot assemblies as defined in any claim 1, the first slot assemblies functioning as the flatness-enhancing device, in a direction transverse to a supplying direction of the supplying an essentially rigid, flat plate, and iii) forming the second slot assemblies as defined in claim 1, the second slot assemblies functioning as the flatness-enhancing device, in a direction opposite to the direction of the first slot assemblies.

14. A sport-technical layer according to claim 1, wherein each of the slots have a depth of 60%-85% of the thickness of the plate.

15. A sport-technical layer according to claim 1, wherein each of the slots have a depth of 80% of the thickness of the plate.

* * * * *